US005299364A

United States Patent [19]

Heikkilä et al.

[11] Patent Number: 5,299,364

[45] Date of Patent: Apr. 5, 1994

[54] ARRANGEMENT AND METHOD FOR TREATMENT OF WEBS USING NOZZLES WITH NEGATIVE PRESSURE

[75] Inventors: Pertti Heikkilä, Raiso; Jaakko Rintanen, Turku, both of Finland

[73] Assignee: Valmet Paper Machinery Inc., Finland

[21] Appl. No.: 938,952

[22] Filed: Sep. 1, 1992

[30] Foreign Application Priority Data

Sep. 5, 1991 [FI] Finland ..... 914194

[51] Int. Cl.[5] ..... F26B 3/00

[52] U.S. Cl. ..... 34/23; 34/156

[58] Field of Search ..... 34/156, 160, 10, 23, 34/155; 226/97

[56] References Cited

U.S. PATENT DOCUMENTS

| | | | |
|---|---|---|---|
| 3,587,177 | 6/1971 | Overly et al. | 34/156 |
| 4,074,841 | 2/1978 | Kramer et al. | 34/156 X |
| 4,247,993 | 2/1981 | Lindstrom | 34/156 |
| 4,290,210 | 9/1981 | Johansson | 34/156 |
| 4,384,666 | 5/1983 | Koponen et al. | 226/97 |
| 4,848,633 | 7/1989 | Hagen et al. | 226/97 |
| 4,893,416 | 1/1990 | Vits | 34/156 |
| 4,932,140 | 6/1990 | Lepisto | 34/156 |
| 5,125,170 | 6/1992 | Krimsky et al. | 34/156 |

FOREIGN PATENT DOCUMENTS

| | | |
|---|---|---|
| 0196107 | 10/1986 | European Pat. Off. . |
| 1774126 | 7/1972 | Fed. Rep. of Germany . |
| 7902469 | 4/1980 | Finland . |

*Primary Examiner*—Henry A. Bennet
*Attorney, Agent, or Firm*—Steinberg & Raskin

[57] ABSTRACT

The invention relates to an arrangement of nozzles with negative pressure intended for the treatment of webs. A nozzle directs a drying and supporting gas flow at the web and which has a box construction, and a nozzle space formed at one side of the nozzle. The nozzle space is provided with a nozzle slot defined by nozzle walls. One of the walls operates as a curved guide face which is fitted to turn the gas flow passed out of the nozzle slot, based on the Coanda effect, so as to make it parallel to the carrier face formed on the top face of the nozzle. At least one second nozzle slot is provided at a distance before said first nozzle slot, in the running direction of the web. A flow guiding fitted in connection with the second nozzle slot is arranged so that the flow has a substantially large velocity component perpendicular to the direction of running of the web. The velocity component parallel to the plane of running of the web of the flow passed out of the second nozzle slot is larger than zero.

22 Claims, 5 Drawing Sheets

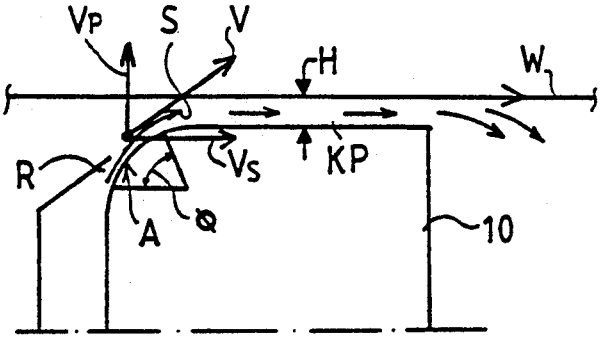
FIG. A1
PRIOR ART
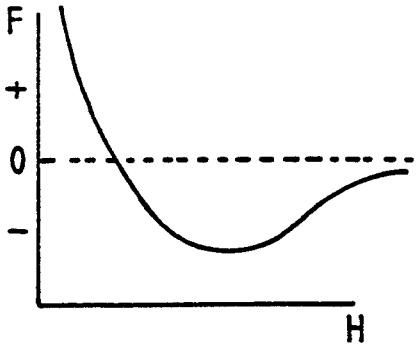
FIG. A2
PRIOR ART
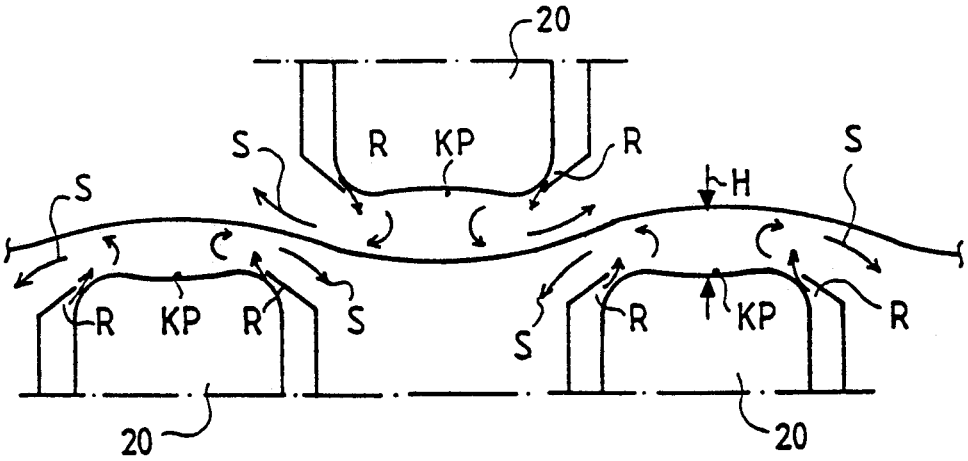
FIG. B1
PRIOR ART
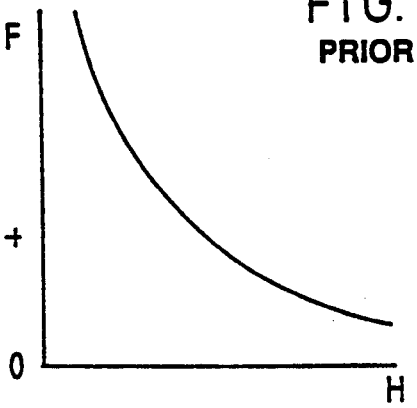
FIG. B2
PRIOR ART

ARRANGEMENT AND METHOD FOR TREATMENT OF WEBS USING NOZZLES WITH NEGATIVE PRESSURE

FIELD OF THE INVENTION

The present invention concerns an arrangement of nozzles with negative pressure intended for the treatment of webs. The invention comprises a nozzle which directs a drying and supporting gas flow at the web and has a box construction, and a nozzle space formed at one side of the nozzle. The nozzle space is provided with a nozzle slot defined by nozzle walls. One of the nozzle walls operates as a curved guide face which is fitted to turn the gas flow passed out of the nozzle slot. Based on the Coanda effect, this gas flow will be parallel to the carrier face formed on the top face of the nozzle.

The invention also relates to a method of treating webs by using an arrangement of nozzles with negative pressure in which the web is supported and dried by means of a gas flow. The gas flow is blown so that it turns and becomes parallel to the running direction of the web.

The nozzle arrangement in the present invention is intended for contact-free support and treatment, such as drying or heat treatment, of paper webs and other continuous webs. The invention is particularly well-suited for use in contact-free support and drying applications of an undried and coated web. In addition, the invention is intended for use in an airborne web dryer, in which such nozzle arrangements in accordance with the present invention are placed either at both sides of the web or only at one side of the web and in which air is blown through the nozzles to support, to dry, and/or to heat the web.

BACKGROUND OF THE INVENTION

Devices based on the blowing of a gas are commonly employed in the manufacture and refining of paper. In such devices, the gas that is blown is passed by means of various nozzle arrangements to one side or both sides of the web. Thereafter, the gas is sucked off for renewed use or for removal, and/or the gas is discharged to the sides of the web.

Prior art devices based on contact-free treatment of a web consist of a number of nozzle boxes, out of which a gas flow is applied to the web to support and dry the web. The prior art nozzles in these devices can be divided into two groups: nozzles with pressure and nozzle with negative pressure. The operation of the pressure nozzle is based on the principle of air cushioning, whereas the nozzles with negative pressure produce a dynamic field of negative pressure and their carrier face attracts the web and stabilizes the run of the web. As is known in the art, the attractive force applied to the web is based on a gas flow field parallel to the web. The gas flow field forms a dynamic negative pressure between the web and the carrier face of the nozzle. Both in the pressure nozzles and in the nozzles with negative pressure, the so-called Coanda effect is commonly utilized to guide the air flow in the desired direction.

In prior art pressure nozzles, an area with positive pressure is formed between the web and the carrier face of the nozzle. The positive pressure attempts to push the web apart from the nozzle as is shown in FIG. B1. Thus, when nozzles with negative pressure are placed at both sides of the web, the pushing forces of the pressure nozzles compensate for each other and the web runs approximately in the middle. The pushing force, i.e. repulsion, applied to the web at a pressure nozzle is generally at all distances higher than, or equal to, 0. This is evident from FIG. B2 where the pushing force produced by a prior art pressure nozzle and applied to a web as a function of the distance between the web and the nozzle is illustrated.

The force applied by pressure nozzles to a web is relatively high. Thus, by means of pressure nozzles, it is possible to treat heavy and fully non-stretching webs. However, most of the prior art nozzles with positive pressure apply sharp jets in a substantially perpendicular direction to the web. As a result, an uneven distribution of the heat transfer coefficient in the longitudinal direction is produced. This uneven distribution frequently causes damage to the quality of the web that is being treated.

In nozzles with negative pressure, an area with a slight negative pressure is formed between the nozzle and the web. This area stabilizes the web at a certain distance from the carrier face. The formation of the negative pressure results from the mode of blowing of the air, whereby the air jet is guided to run as parallel to the carrier face and web (as seen in FIG. A1). At very short distances between the carrier face of the nozzle and the web, a pushing force, e.g. repulsion, is applied to the web, and at longer distances, an attraction force. FIG. A2 illustrates the attraction/repulsion force applied to a web in connection with a prior art nozzle with negative pressure as a function of the distance between the web and the nozzle.

The force applied to the web by prior art nozzles with negative pressure is relatively low. As a result, these nozzles are, generally, not employed for the treatment of heavy webs of when the tension of the web is low. Thus, nozzles with negative pressure are, generally, employed in devices whose length exceeds 5 meters and in which guide rolls are placed at both sides to support the web.

In respect of the prior art connected with and closely related to the present invention, reference is made to the FI Patent Application Nos. 60,261, 68,723, and 77,708 as well as to the publication by D. W. McLaughlin, I. Greber, The American Society of Mechanical Engineers, *Advances in Fluids* 1976, "Experiments on the Separation of a Fluid Jet from a Curved Surface", pages 14 to 29. Among these publications, the Finnish patents 60,261 and 77,708 describe pressure nozzles, and Finnish patent 68,723 describes a nozzle for an airborne web dryer by whose means a drying and supporting gas flow with negative pressure is applied to a web to be dried.

In the embodiment described in Finnish patent 68,723, the nozzle slot of the nozzle is placed in the gas flow direction before the level of the inlet edge of the curved guide face. With the occurring gas flow rates, the ratio between the width of the nozzle slot and the curve radius of the guide face can be selected so that the gas flow is separated from the curved guide face substantially before its trailing edge. In this prior art inventions, the nozzle comprises a nozzle box, at one of whose sides there is a nozzle slot. The nozzle slot is defined by the front plate of the flow, on one side, and by the front wall of the nozzle chamber, on the other side and provides a curved flow guide face and a deck part.

The cited paper "Experiments on the Separation of a Fluid Jet from a Curved Surface" examines the mechanisms of separation of a flow jet from a curved wall and the various parameters affecting same. With regard to the present invention, the results that are relevant are illustrated in the graphic presentation in FIG. 5, on page 21 of the above mentioned paper, in which a cluster of curves is shown in a system of coordinates. The vertical axis represents the angle of separation and the horizontal axis represents the Reynolds number. The parameter of the cluster of curves is the ratio W/R=ratio of the width of the nozzle slot to the curve radius of the face. It can be seen from these study results that, with the flow parameters occurring in the nozzle constructions, the follow angle $\phi$ is preferably in the range of about 45° to about 70°.

OBJECTS AND SUMMARY OF THE INVENTION

An object of the operation of the nozzle with negative pressure in the present invention is to provide a gas flow field which is parallel to the web, attracts the web, and stabilizes the run of the web at a certain distance from the carrier face of the nozzle.

Another object of the present invention is to provide nozzles which are suitable for the treatment of sensitive materials. In a gas flow produced by a nozzle with negative pressure in accordance with the invention, the transfer of heat in the longitudinal direction of the web is even, so that the nozzles with negative pressure are suitable for the treatment of sensitive materials. They can also be used for one-sided treatment of a web.

Yet another object of the invention is to provide a nozzle with negative pressure by whose means an increased heat transfer capacity and an improved conduct of as web are obtained, as compared with the prior art nozzles when the quantity of air used per unit of area of the web and the blower power are equal.

In view of achieving the above objects and others, in the arrangement of nozzles with negative pressure in the present invention, at least two nozzle slots are provided: a first nozzle slot and a second nozzle slot located at a distance before the first nozzle slot in the running direction of the web. In view of improving the heat transfer coefficient, the flow guiding means fitted in connection with the second nozzle slot is arranged so that the flow has a substantially large velocity component which is perpendicular to the running direction of the web. The velocity component of the flow passed out of the second nozzle slot parallel to the running of the web is larger than zero.

In a method in the present invention, the web is supported and dried by means of at least one second gas flow beside a first gas flow. A second gas flow is blown in the running direction of the web before the first gas flow, and is directed so that it has a substantially large velocity component perpendicular to the running direction of the web and such that the velocity component parallel to the running direction of the web is larger than zero.

A preferred embodiment of the present invention is based on a novel geometric design of the nozzle and on a novel principle air blowing.

In an arrangement in accordance with the invention, the drying and supporting gas flow is blown out of the nozzle slots as two flows. The second flow of the two flows in the running direction of the web, is turned, because of the Coanda effect, parallel to the carrier face. The first flow is directed at a suitable angle in relation to the carrier face, so that the first flow does not follow the carrier face but is directed towards the web. As a result of this arrangement, a more efficient transfer of heat is obtained.

The guide face of the first air flow is not curved, and the air is separated from the carrier face more readily. Furthermore, in the arrangement, it is preferable that the distance of the former carrier face, in the running direction of the web, from the web is slightly larger than the distance of the latter carrier face, in the running direction of the web. Therefore, it is avoided that the flow directed towards the web should push the web further apart from the nozzle.

BRIEF DESCRIPTION OF THE DRAWINGS

The following drawings are illustrative of embodiments of the invention and are not meant to limit the scope of the invention as encompassed by the claims.

FIG. A1 is a schematic illustration of a prior art nozzle with negative pressure.

FIG. A2 shows the attraction/pushing force applied to the web as a function of the distance between the carrier face of a prior art nozzle with negative pressure and the web.

FIG. B1 is a schematic illustration of a prior art nozzle with positive pressure.

FIG. B2 shows the pushing force obtained with a prior art nozzle with positive pressure as a function of the distance between the web and the carrier face of the nozzle.

Figure 1:
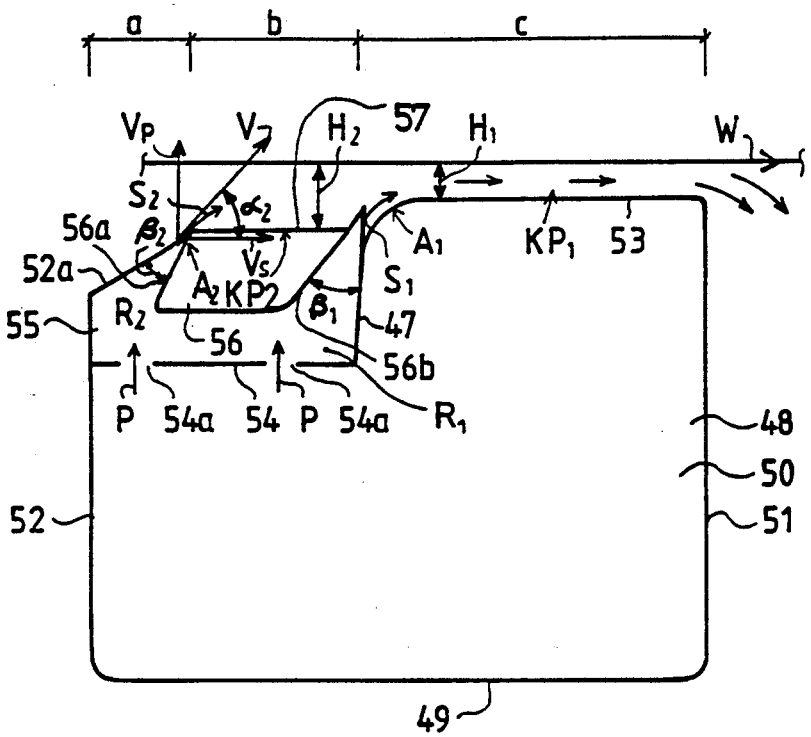

FIG. 1 is a schematic illustration of an embodiment of the nozzle arrangement in accordance with the invention.

Figure 2:
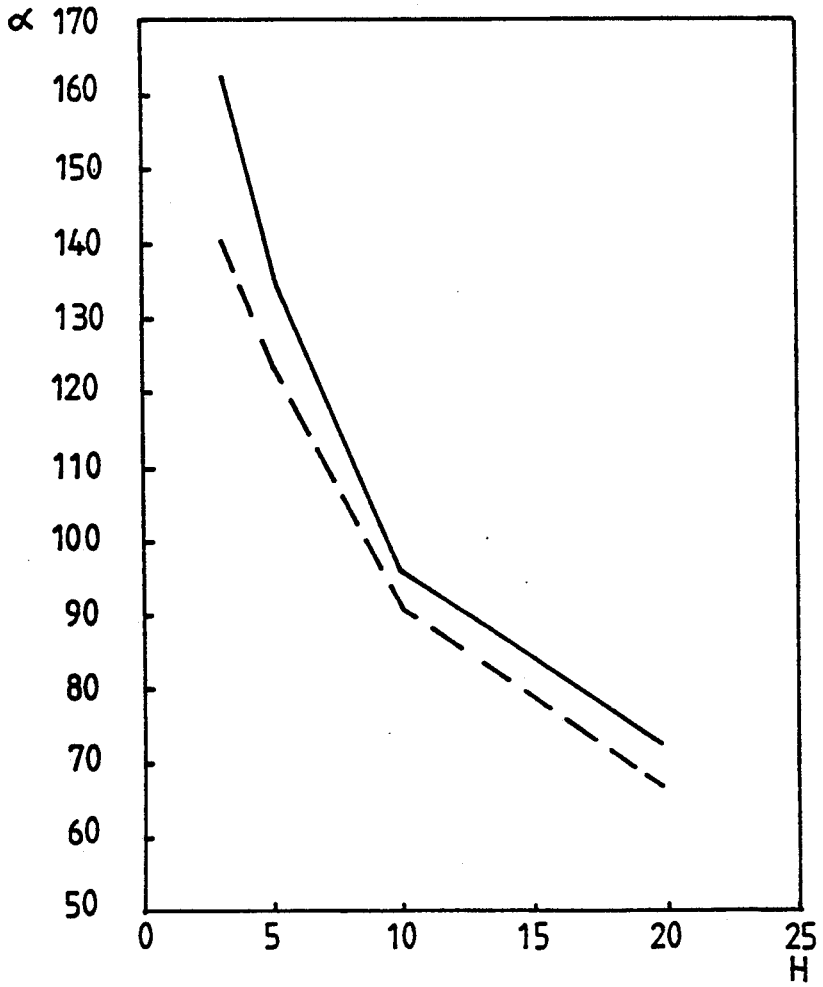

FIG. 2 shows the heat transfer capacity of a nozzle in accordance with the invention as a function of the distance between the carrier face of the nozzle and the web as compared with the corresponding capacity of a prior art nozzle.

Figure 3:
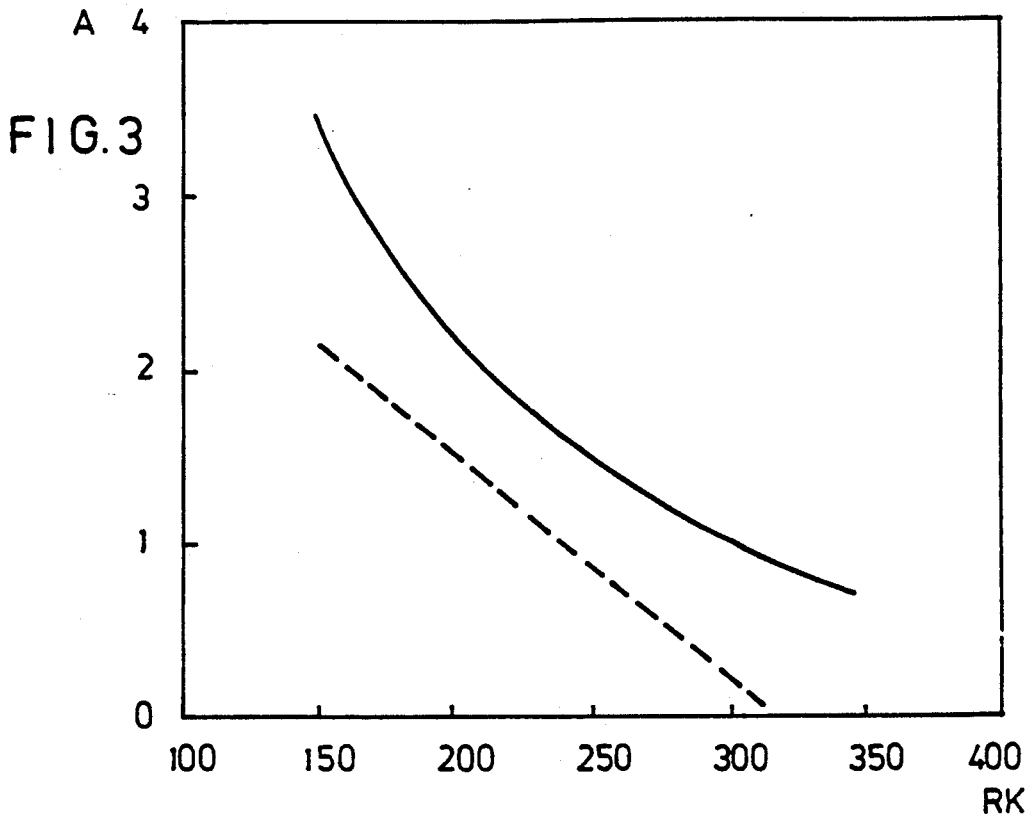

FIG. 3 shows the intensities of a sine wave measured for a nozzle in accordance with the invention and a prior art nozzle as a function of the web tension.

Figure 4:
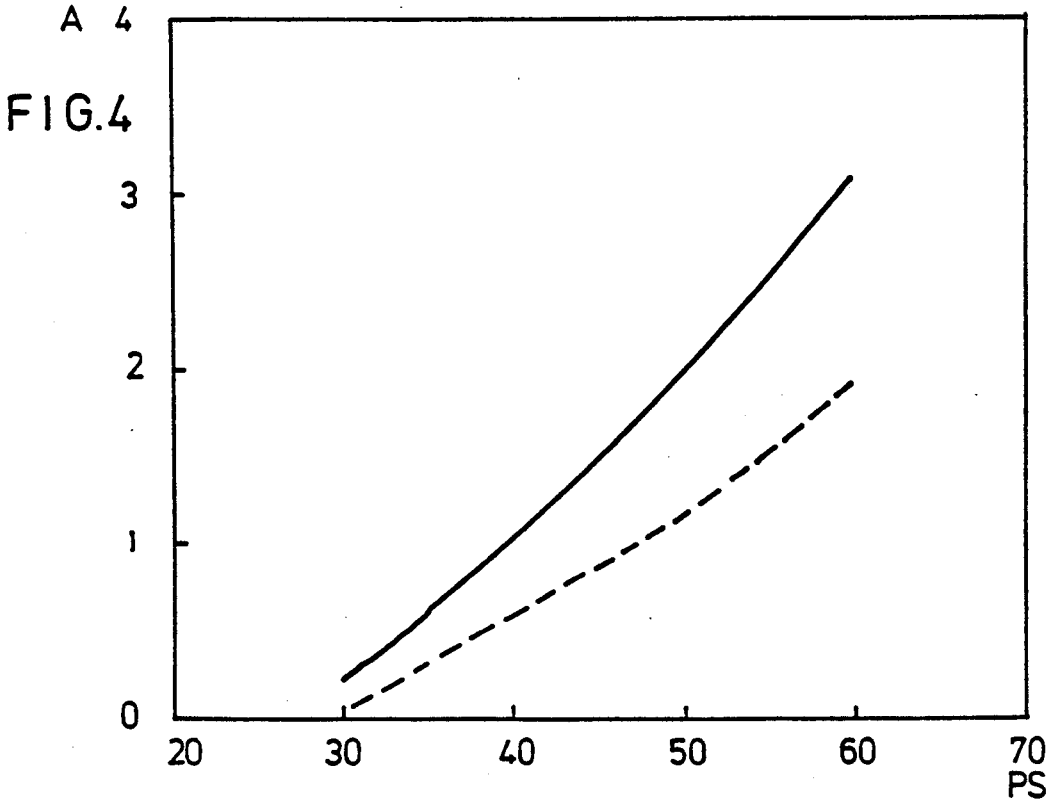

FIG. 4 shows the intensities of a sine wave measured for a nozzle in accordance with the invention and a prior art nozzle as a function of the blow speed.

Figure 5:
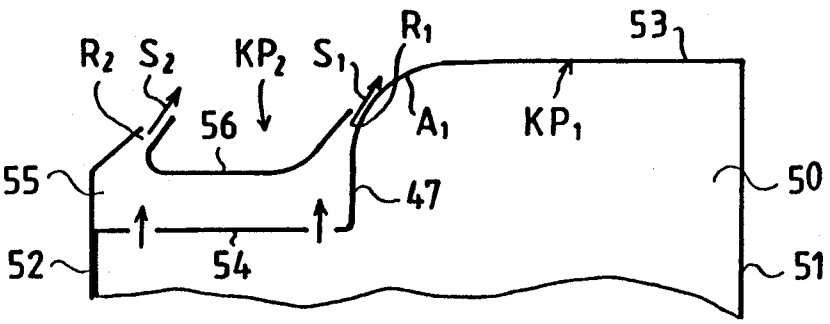

FIG. 5 shows a further embodiment of a solution of the area of the nozzle openings in an arrangement of nozzles with negative pressure.

Figure 6:
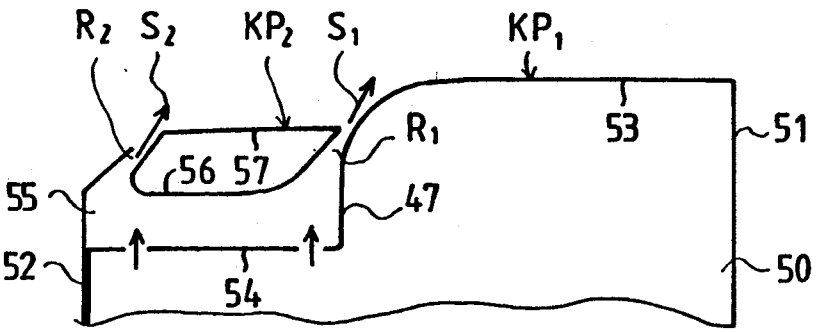

FIG. 6 shows another embodiment of the area of the nozzle openings in an arrangement of nozzles with negative pressure.

Figure 7:
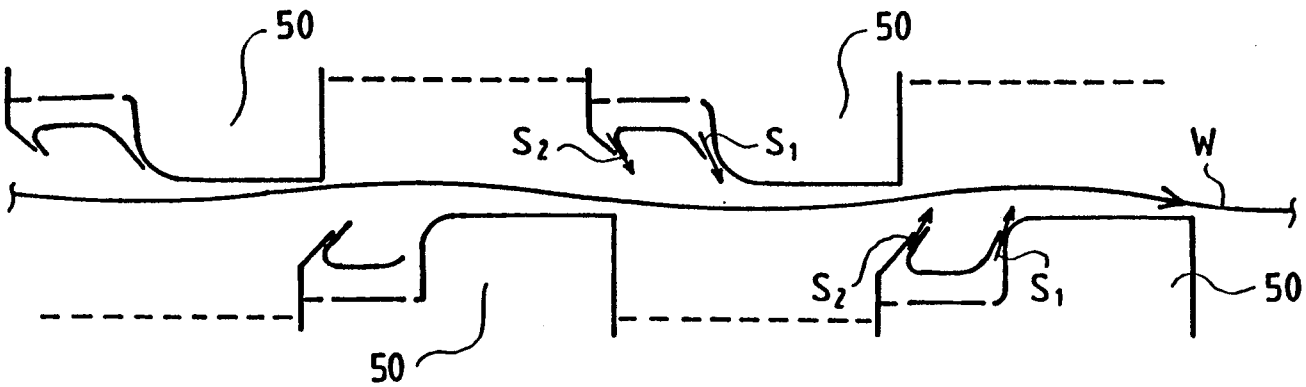

FIG. 7 is a schematic illustration of the field of nozzles and the run of the web achieved by means of a nozzle in accordance with the invention.

Figure 8:
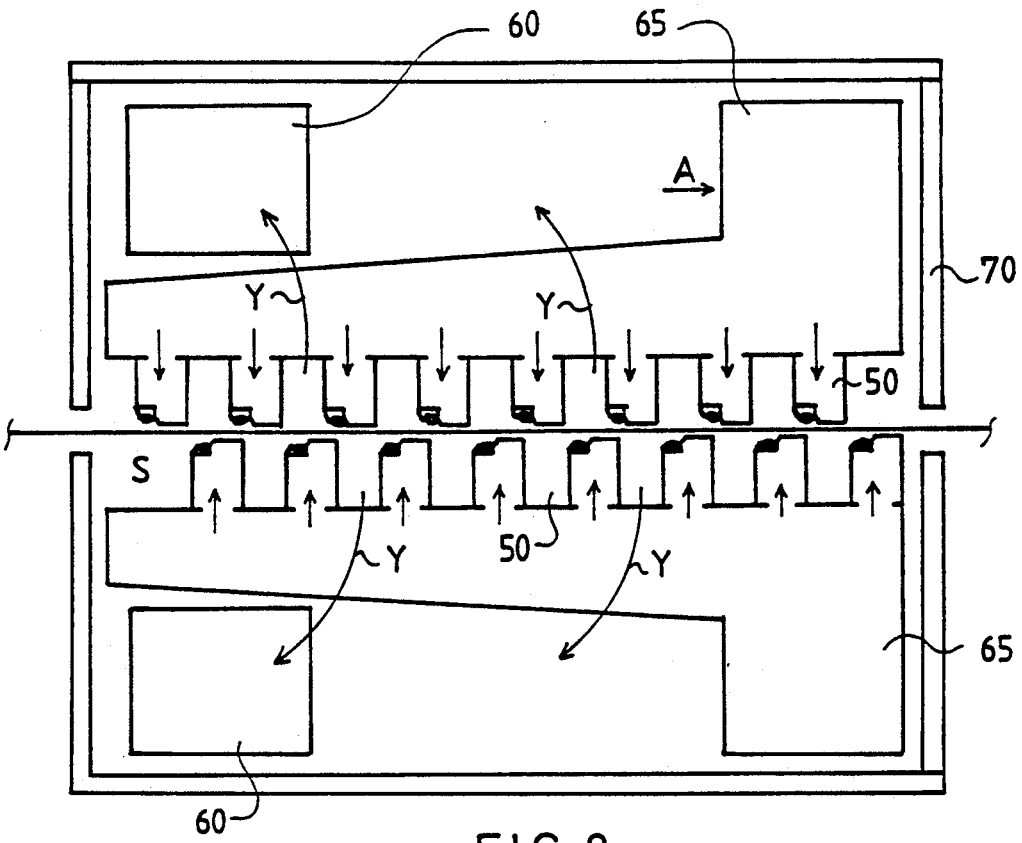

FIG. 8 is a schematic illustration of a two-sided airborne web dryer provided with nozzles with negative pressure in accordance with the invention.

Figure 9:
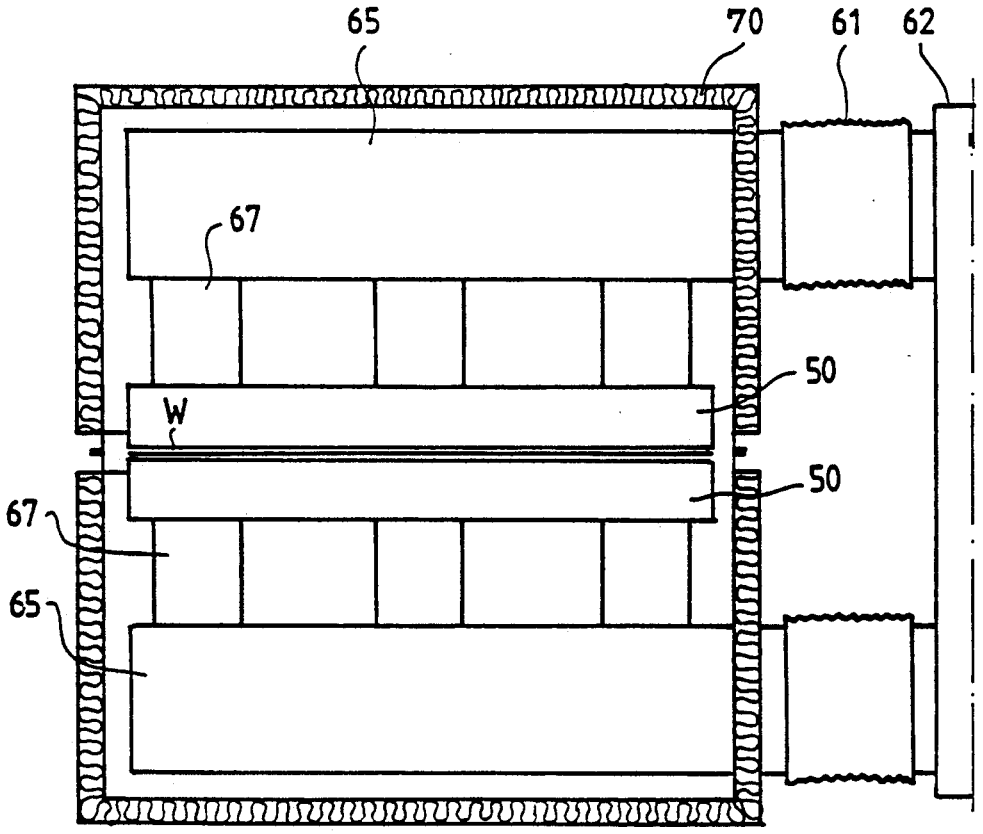

FIG. 9 is a schematic sectional view along the line A through FIG. 8.

DETAILED DESCRIPTION OF THE INVENTION

Referring first to the prior art nozzles, FIG. A1 is a schematic illustration of a prior art nozzle with negative pressure. The carrier face KP of the nozzle 10 with negative pressure guides the air flow S which is discharged from the nozzle slot R of the nozzle 10. The distance between the web W and the carrier face KP of the nozzle 10 is denoted with the reference H. Between the nozzle 10 and the web W, an area of slight negative pressure is formed. This negative pressure stabilizes the web W at a certain distance from the carrier face KP, e.g. from about 5 mm to about 8 mm.

The formation of the negative pressure is a consequence of the manner of blowing the air, in which the air jet S is guided to run as parallel to the carrier face KP and to the web W. At very short distances between the nozzle 10 and the web W, a pushing force is applied to the web W. At larger distances, an attracting force H is applied as seen in FIG. A2. FIG. A2 illustrates the attracting/pushing force F applied to the web W as a function of the distance H between the nozzle and the web W. The attracting force is represented by the negative portion of the function, and the pushing force, by the positive portion.

As shown in FIG. A1, based on the Coanda effect the flow S is discharged from the nozzle slot R and follows the curved guide face A on the sector $\phi$. The sector $\phi$ varies within the range of about 45° to about 70°. The flow is separated from the curved guide face A if the velocity vector v of the flow has a remarkably large velocity component $v_p$ perpendicular to the web W (not shown in the figure). If the angle $\phi$ is larger than 45°, the velocity component $v_s$ parallel to the web W of the flow is larger than the velocity component $v_p$ perpendicular to the web.

FIG. B1 is a schematic illustration of a prior art invention of a nozzle with positive pressure. FIG. B2 is an illustration of the force F produced by such a prior art nozzle and applied to the web W, as a function of the distance H between the web W and the carrier face KP of the nozzle. In the nozzle 20 with positive pressure, an area with positive pressure is formed between the web W and the carrier face KP of the nozzle 20. This positive pressure area attempts to push the web W away from the nozzle 20. Therefore, nozzles 20 with positive pressure must be placed at both sides of the web W, such that the pushing forces compensate for each other and the web W runs approximately in the middle. In a nozzle 20 with positive pressure, the force applied to the web is at all distances higher than 0, as can be seen in FIG. B2, i.e. a pushing force is applied to the web W.

Referring now to the present invention, FIG. 1 is a schematic illustration of a nozzle 50, with a box construction. The box construction consists of a rear wall 51, a bottom wall 49, a top wall 53, and a front wall 52. On the top face of the top wall 53, a carrier face $KP_1$ is formed. In the interior of the nozzle 50, a chamber 48 is formed. In the chamber 48, a separate section (or nozzle space) 55 has been defined by means of partition walls, for example a partition wall 54 parallel to the bottom wall 49 and a partition wall 47 parallel to the rear and front walls 51,52. The drying gas is passed into the chamber 48. Then the drying gas is passed out of the chamber 48 as a flow P into the nozzle space 55, for example, through openings **54*a* in the partition wall 54 parallel to the bottom wall 49 of the nozzle space 55**.

In the embodiment shown in FIG. 1, nozzle slots $R_1$ and $R_2$ have been formed in the nozzle space 55 so that the nozzle walls $A_1$;**56*b* of the first nozzle slot $R_1$ are formed in the guide face $A_1$. The guide face $A_1$ is connected with the partition wall 47 in the chamber 48 and with the rear wall 56*b* of the intermediate piece 56 in the nozzle space 55. The nozzle walls 52*a*,56*a* of the second nozzle slot $R_2$ are formed from the extension 52*a* of the front wall 52 of the chamber 48 and of the front wall 56*a* of the intermediate piece 56. For the purpose of formation of the nozzle walls 56*a*,65*b*, between the nozzle slots $R_1$,$R_2$ in the nozzle space 55 there is an intermediate piece 56, which comprises a rear wall 56*b*, a front wall 56*a*. and a top wall 57**, on whose top face the carrier face $KP_2$ is formed.

The nozzle slot $R_1$ becomes narrower in the running direction of the drying gas flow $S_1$ so that the narrowest point is placed at the outlet opening. The narrowing angle $\beta_1$ is from about 10° to about 40°, preferably about 3020 . The narrowing angle $\beta_2$ of the nozzle slot $R_2$ is about 20° to about 50°, preferably about 30° to about 40°.

The first nozzle slot $R_1$ and the second nozzle slot $R_2$ are placed at a distance from one another substantially at the same side of the nozzle 50 at the side of the inlet direction of the web W. In the running direction of the web W, the second nozzle slot $R_2$ is placed before the first nozzle slot $R_1$.

Out of the nozzle slot $R_1$, the gas flow is discharged into the space between the web W and the nozzle 50, being guided by the curved guide face $A_1$. Based on the Coanda effect, the gas flow turns and becomes parallel to the first carrier face $KP_1$. The air from the nozzle slot $R_2$ is guided as a flow $S_2$ towards the web W, whereby a higher heat transfer coefficient is obtained than by turning the flow so that is becomes parallel to the carrier face $KP_2$.

The velocity component $v_p$ perpendicular to the direction of the web W of the drying-gas flow $S_2$ discharged out of the nozzle slot $R_2$, is sufficiently large in relation to the velocity component $v_s$ parallel to the plane of running of the web W of the flow $S_2$. As a result, the flow $S_2$ does not start following the carrier face $KP_2$ but is directed towards the web W. The velocity component $v_s$ parallel to the plane of running of the web W is larger than zero. The ratio $v_p/v_s$ of the velocity components $v_p$ and $v_s$ is in the range of about 0.4 to about 2.0, preferably in the range of about 0.8 to about 1.5 and is represented by tan $\alpha_2$. The magnitude of the angle $\alpha_2$ is preferably from about 40° to about 70°.

In the present invention, drying gas is blown out of the nozzle slots $R_1$ and $R_2$. Due to the Coanda effect, the flow $S_1$ blown out of nozzle slot $R_1$ is turned parallel to the carrier face $KP_1$. The flow $S_2$ blown out of nozzle slot $R_2$ is directed at a suitable angle $\alpha_2$ in relation to the carrier face $KP_2$. As a result, the flow $S_2$ does not follow the carrier face $KP_2$ but is directed towards the web W, so that a more efficient transfer of heat is achieved.

In view of the separation of the flow, it is preferable that the edge $A_2$, which comprises an extension of the front wall **56*a* of the intermediate piece 56** and which acts as a guide face, is not rounded. The angle formed by the edge $A_2$ is equal to 180°- $\alpha_2$. Further, it is preferable that the distance $H_2$ of the carrier face $KP_2$ from the web W is slightly larger than the distance $H_1$ of the carrier face $KP_1$ from the web W in order that the flow $S_2$ should not push the web W further apart from the nozzle.

With respect to the dimensional proportions of the nozzle 50 illustrated in FIG. 1, the order of magnitude of the distance a of the nozzle slot $R_2$ from the front wall 52 of the nozzle 50 is about 20 mm. The distance b between the nozzle slots $R_1$ and $R_2$ is about 30 mm. The distance c of the first nozzle slot $R_1$ from the rear wall 51 of the nozzle 50 is about 60 mm. The width of nozzle slot $R_1$ is about 2 mm, and the width of nozzle slot $R_2$ is about 1 mm. If necessary, the nozzle 50 can also be manufactured on different scales so that the dimensions given above are multiplied, e.g., by a scale factor at between 0.5 and 2.5, preferably between 0.8 and 2.0. The blow velocity employed in the nozzle 50 in each nozzle slot $R_1$ and $R_2$ is preferably of an order of about 30 m/s to about 60 m/s. The distance $H_1$ of the carrier face $KP_1$ from the web W is from about 3 mm to about 10 mm, preferably from about 4 mm to about 7 mm. The distance $H_2$ of the carrier face $KP_2$ from the web W is from about 6 mm to about 15 mm, preferably from about 7 mm to about 11 mm.

In an additional embodiment, the nozzle 50 can be designed so that for each nozzle slot $R_1$,$R_2$, a separate nozzle space 55 is formed in the nozzle 50.

FIG. 2 illustrates the heat transfer capacity of an arrangement of nozzles with negative pressure in the present invention as compared with a prior art nozzle of a corresponding type in an example test. The heat transfer coefficient $\alpha$ obtained in the present invention, as a function of the distance H between the nozzle and the web, is illustrated by the solid line. The heat transfer factor $\alpha$ of the prior art nozzle, as a function of the distance between the nozzle and the web, is illustrated by the dashed line.

In the test, the following values were used: blow velocity of about 60 m/s with both nozzles, the width of nozzle slot was about 2.5 mm with the prior art nozzle and the total width of the two nozzle slots of the nozzle of the present invention was about 3.0 mm. The spacing of nozzles with the prior art nozzle was about 180 mm and the spacing of nozzles with the present invention was about 220 mm. The air quantity blown with the prior art nozzle was about 0.83 $m^3/m^2/s$, and the quantity blown with the nozzle of the present invention was about 0.82 $m^3/m^2/s$. On the vertical axis the heat transfer coefficient $\alpha$ is given in the units $W/m^2/°C$. As can be seen from this figure, the nozzle in accordance with the present invention is about 10% more efficient than the nozzles known in the prior art.

FIG. 3 illustrates the intensities of the sine wave as a function of the web tension in a test example as measured for the nozzle in the present invention (solid line) and for a prior art nozzle (dashed line). The unit of intensity of the sine wave used is the height A of the wave in millimeters, and the unit of web tension $R_k$ used is N/m. In the test example measurements, an LWC-paper was used while the spacing of nozzles was about 220 mm, the blow velocity about 45 m/s, the distance between the web and the nozzle about 6 mm, and the web speed about 400 m/min.

FIG. 4 illustrates the intensity of the sine wave as a function of the blow velocity PS for a nozzle of the present invention (solid line) and for a prior art nozzle (dashed line). The values used in the test were the same as those in the preceding example, while the web tension was 250 N/m. The unit of intensity of the sine wave was the height of the wave as millimeters and the unit of the blow velocity PS was m/s.

In both test examples (the result of which are indicated in FIGS. 3 and 4), the nozzle in accordance with the present invention provided a stronger sine wave, and also a better running quality. In the test runs carried out, it was noticed that the nozzle in accordance with the invention, as compared with the prior art nozzle, possessed a stronger sine wave and produced a more stable run of the web and less folds in the machine direction.

FIGS. 5 and 6 are schematic illustrations of additional embodiments of the design of the second carrier face $KP_2$. FIG. 5 shows an embodiment in which the carrier face $KP_2$ between the nozzle slots $R_1$ and $R_2$ is shaped as a recess. In FIG. 6, the carrier face $KP_2$ between the nozzle slots $R_1$,$R_2$ is planar. In the embodiment as shown in FIG. 5, the intermediate piece 56, which forms the nozzle slots $R_1$ and $R_2$ with the walls 47 and 52, respectively, is designed as U-shaped, so that the carrier face $KP_2$ does not become planar. With respect to the remaining parts of its construction, the embodiment shown in FIG. 5 corresponds to that shown in FIG. 1. In FIG. 6, the intermediate piece 56, which forms the nozzle slots $R_1$,$R_2$ with the walls 47 and 52, is closed so that the wall 57 forms a planar carrier face $KP_2$ on its top face.

FIG. 7 is a schematic illustration of an example of an arrangement of nozzles with negative pressure in accordance with the invention. The run of the web W, when such an arrangement of nozzles with negative pressure is employed, is also illustrated. The nozzles 50 are placed at both sides of the web so that the drying-gas flows $S_1$,$S_2$ support the web W evenly. The nozzles 50 may also be placed at one side of the web only. Besides the shape in accordance with FIG. 5, the nozzle 50 may also be similar to that shown in FIGS. 1 or 6.

FIG. 8 is a schematic illustration of a dryer provided with nozzles in accordance with the invention. At both sides of the web W, nozzles 50 are provided, through which drying gas S is blown to support and to dry the web W. The return flow is denoted with the reference arrows Y. The return flow Y returns into the return duct 60. From the inlet duct 65, the drying gas is passed into the nozzles 50. The reference numeral 70 represents the frame constructions of the dryer.

FIG. 9 is a sectional view of section A of FIG. 8 of the dryer as seen in the direction of running of the web W. From the distribution box 62, the drying gas is passed both to the upper boxes and to the lower boxes of the airborne web dryer. The inlet ducts 65 communicate with the distribution box 62 for exhaust air through resilient connectors. In a corresponding manner, the exhaust ducts communicate with the distribution box for exhaust air through resilient connectors. The resilient connectors and the distribution boxes are air ducts. The dryer is supported on the frame separately by means of other devices (not shown). From the inlet duct 65, the drying gas is passed through the distribution ducts 67 into the nozzles 50, from which the drying gas is blown further to support and to dry the web W.

Even though in FIGS. 7, 8 and 9, nozzles 50 are shown placed at both sides of the web W, it should be emphasized that the nozzle construction in accordance with the invention can also be applied to airborne web dryers in which nozzles 50 are placed at one side of the web W only.

In additional embodiments of the present invention, the second nozzle $R_2$ may be shaped in other ways, for example in accordance with the illustration in FIG. 2 in Finnish Patent 68,723. It is preferable that the gas flow $S_2$ does not follow the carrier face $KP_2$ but is directed at the web W.

In the embodiments illustrated in the figures, the velocity component $v_s$ parallel to the running plane of the web W is shown as parallel to the running direction of the web W. However, the invention also includes the embodiment wherein the running direction of the web may be opposite to that shown in FIG. 1.

The examples provided above are not meant to be exclusive. Many other variations of the present invention would be obvious to those skilled in the art, and are contemplated to be within the scope of the appended claims.

What is claimed is:

1. An arrangement of nozzles for the treatment of a web, comprising a nozzle which directs a drying and supporting gas flow at a web running above said nozzle, said nozzle having a box construction with a top face, and a first carrier face arranged on a side of said top face of said nozzle, said nozzle having a first and a second nozzle slot on an opposite side of said top face, said first nozzle slot being defined by first nozzle walls structured and arranged to pass a first gas flow out of said first nozzle slot, one of said first nozzle walls comprising a curved guide face structured and arranged to guide the first gas flow out of said first nozzle slot due to a Coanda effect and to cause the first gas flow to become parallel to said first carrier face, said second nozzle slot located at a distance from and before said first nozzle slot in the running direction of the web, said second nozzle slot being defined by second nozzle walls structured and arranged to pass a second gas flow out of said second nozzle slot and toward the web, and means to direct the second gas flow toward the web such that it has a velocity component perpendicular to the running direction of the web which is substantially equal to or greater than a velocity component parallel to the running direction of the web, said parallel velocity component being larger than zero.

2. An arrangement of nozzles as claimed in claim 1, wherein said means comprise an extension connected to said second nozzle walls.

3. An arrangement of nozzles as claimed in claim 1, further comprising a second carrier face on said top face of said nozzle, said second carrier face located between said first and said second nozzle slots.

4. An arrangement of nozzles as claimed in claim 3, wherein the distance between said first carrier face and the web is shorter than the distance between said second carrier face and the web.

5. An arrangement of nozzles as claimed in claim 3, wherein the distance between said first carrier face and the web is from about 3 mm to about 10 mm.

6. An arrangement of nozzles as claimed in claim 5, wherein the distance between said first carrier face and the web is from about 4 mm to about 7 mm.

7. An arrangement of nozzles as claimed in claim 5, wherein the distance between said second carrier face and the web is from about 6 mm to about 15 mm.

8. An arrangement of nozzles as claimed in claim 7, wherein the distance between said second carrier face and the web is from about 7 mm to about 11 mm.

9. An arrangement of nozzles as claimed in claim 1, wherein said means direct the second gas flow toward the web at an angle of between about 40° and about 70° in relation to the running direction of the web.

10. An arrangement of nozzles as claimed in claim 3, wherein said second carrier face is shaped as a recess.

11. An arrangement of nozzles as claimed in claim 3, wherein said second carrier face is planar.

12. An arrangement of nozzles as claimed in claim 1, wherein said first nozzle walls narrow at an angle in the direction of said top face.

13. An arrangement of nozzles as claimed in claim 12, wherein the angle of narrowing is from about 10° to about 40°.

14. An arrangement of nozzles as claimed in claim 13, wherein the angle of narrowing is about 30°.

15. An arrangement of nozzles as claimed in claim 1, wherein said second nozzle walls narrow at an angle in the direction of said top face.

16. An arrangement of nozzles as claimed in claim 15, wherein the angle of narrowing is from about 20° to about 50°.

17. An arrangement of nozzles as claimed in claim 16, wherein the angle of narrowing is from about 30° to about 40°.

18. A dryer for treating and heating a web comprising a plurality of nozzles as claimed in claim 1.

19. A dryer as claimed in claim 18, wherein said nozzles are arranged on opposite sides of the web.

20. A method for treating a web, comprising providing a first and a second gas flow in the direction of a web being treated, supporting and drying the web by means of the first and second gas flows, directing the first gas flow such that the first gas flow turns and becomes parallel to the running direction of the web, directing the second gas flow toward the web such that the second gas flow has a substantially large velocity component perpendicular to the running direction of the web which is substantially equal to or greater than a velocity component parallel to the running direction of the web, said velocity component parallel to the web being larger than zero, and arranging the second gas flow before the first gas flow in the running direction of the web.

21. A method as claimed in claim 20, further comprising directing the second gas flow such that the ratio of the velocity component perpendicular to the running direction of the web to the velocity component parallel to the running direction of the web is from about 0.4 to about 2.

22. A method as claimed in claim 21, wherein the ratio of the velocity component perpendicular to the running direction of the web to the velocity component parallel to the running direction of the web is from about 0.8 to about 1.5.

* * * * *